US006109356A

United States Patent [19]

Echols et al.

[11] Patent Number: 6,109,356

[45] Date of Patent: Aug. 29, 2000

[54] WELL COMPLETION TOOL HAVING PRESSURE RELIEF CAPABILITY INCORPORATED THEREIN AND ASSOCIATED METHOD

[75] Inventors: Ralph H. Echols, Dallas, Tex.; Ronnie D. Finley, New Iberia, La.

[73] Assignee: Halliburton Energy Services, Inc., Dallas, Tex.

[21] Appl. No.: 09/090,713

[22] Filed: Jun. 4, 1998

[51] Int. Cl.[7] ..... E21B 33/12

[52] U.S. Cl. ..... 166/386; 166/324; 166/332.7

[58] Field of Search ..... 166/383, 386, 166/317, 319, 324, 332.1, 332.7

[56] References Cited

U.S. PATENT DOCUMENTS 4,428,428 1/1984 Smyrl et al. ..... 166/278
5,137,088 8/1992 Farley et al. ..... 166/319
5,320,181 6/1994 Lantier, Sr. et al. ..... 166/386
5,810,084 9/1998 Echols ..... 166/242.7
5,836,395 11/1998 Budde ..... 166/321

*Primary Examiner*—David Bagnell
*Assistant Examiner*—Zakiya Walker
*Attorney, Agent, or Firm*—Paul I. Herman; Marlin R. Smith

[57] ABSTRACT

A well tool is disclosed, which includes features that enhance the reliability and safety of wellsite operations. In one disclosed embodiment, a pressure relief device is incorporated in a well completion tool. The pressure relief device is in fluid communication with fluid delivery and return flowpaths of the tool. When a predetermined differential fluid pressure is experienced, the pressure relief device opens and permits fluid flow between the fluid delivery and return flowpaths. Associated methods of protecting well tools are disclosed as well.

23 Claims, 3 Drawing Sheets

WELL COMPLETION TOOL HAVING PRESSURE RELIEF CAPABILITY INCORPORATED THEREIN AND ASSOCIATED METHOD

BACKGROUND OF THE INVENTION

The present invention relates generally to wellsite operations and, in an embodiment described herein, more particularly provides a well completion tool having pressure relief capabilities, and associated methods.

In many wellsite operations, fluid is delivered into a well and then returned. For example, in drilling operations, drilling mud is typically circulated into a well through a drill string and returned to the earth's surface through an annulus formed between the drill string and the wellbore. In stimulation operations, fluid may be delivered to the wellbore through a fluid delivery flowpath of a well tool and returned along a fluid return flowpath.

Where the stimulation operation is, for example, a formation fracturing operation, proppant may be suspended in the fluid when it is delivered to the wellbore by pumps at the earth's surface. To prevent return of the proppant with the fluid through the fluid return flowpath, one or more screens are generally attached to the well tool, so that the returned fluid does not include the proppant. Unfortunately, where very high flow rates are used, the wellbore surrounding the well tool may fill quickly, with proppant, covering the screens, substantially restricting fluid flow therethrough and creating excessive differential pressure across portions of the well tool. This situation may occur so rapidly that there is not enough time to shut down the pumps and prevent collapse of the screens and/or other portions of the well tool. The problem also exists in other well completion operations, such as gravel packing.

In the past, attempts to remedy this problem have focused on preventing excessive pressure differentials from being applied to the well tool at the earth's surface. For example, sensors may be utilized at the earth's surface to monitor the pressure applied to the fluid delivered into the well and the pressure of the fluid returned from the well. If the differences between the pressures become excessive, the pumps may be slowed or stopped as needed to decrease the pressure differential.

In very high flow rate operations, however, the distance between the well tool and the sensors, and the resulting stored energy in the large mass of fluid flowing through the delivery and return flowpaths, produces a significant lag between the time at which remedial measures are taken at the earth's surface and the time at which a decrease in the pressure differential is experienced at the well tool.

From the foregoing, it can be seen that it would be quite desirable to provide pressure relief capabilities in well tools utilized in wellsite operations. In particular, these pressure relief capabilities could be incorporated into the well tool, in order to minimize any time lag between the occurrence of excessive differential pressure and relief of that differential pressure. Additionally, where the fluid may carry, particulate matter, such as proppant or gravel, a pressure relief device incorporated in the tool could include a filtering device. It is accordingly an object of the present invention to provide such a well tool and associated methods.

SUMMARY OF THE INVENTION

In carrying out the principles of the present invention, in accordance with an embodiment thereof, a well tool is provided which includes a pressure relief device incorporated therein. The pressure relief device is in fluid communication with fluid delivery and fluid return flowpaths of the well tool. When a predetermined differential pressure is experienced between the delivery and return flowpaths, the pressure relief device opens to permit fluid flow between the flowpaths, thereby relieving the pressure differential. The pressure relief device may include a filtering device for filtering particulate matter from the fluid. Associated methods of protecting well tools are also provided.

One pressure relief device disclosed herein includes a plug sealingly disposed within a fluid passage of the well tool. Each opposite end of the fluid passage is in fluid communication with one of the fluid deliver and return flowpaths. The plug is releasably secured in the fluid passage, so that, when the predetermined differential pressure is applied, the plug displaces relative to the passage and permits flow therethrough. In the exemplary embodiment described below, the pressure relief device is installed in a crossover housing of a well completion tool of the type used in formation fracturing and gravel packing operations.

Another pressure relief device disclosed herein includes a sleeve slidingly and sealingly engaged with a sidewall portion of the well tool. The sidewall separates the fluid delivery and return flowpaths. When the predetermined differential pressure is applied, the sleeve is released for displacement relative to the sidewall, thereby permitting fluid flow through a fluid passage formed through the sidewall, and relieving the differential pressure. The pressure relief devices described herein may be used separately, in combination with each other, in combination with other methods, and in other types of well tools and wellsite operations.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
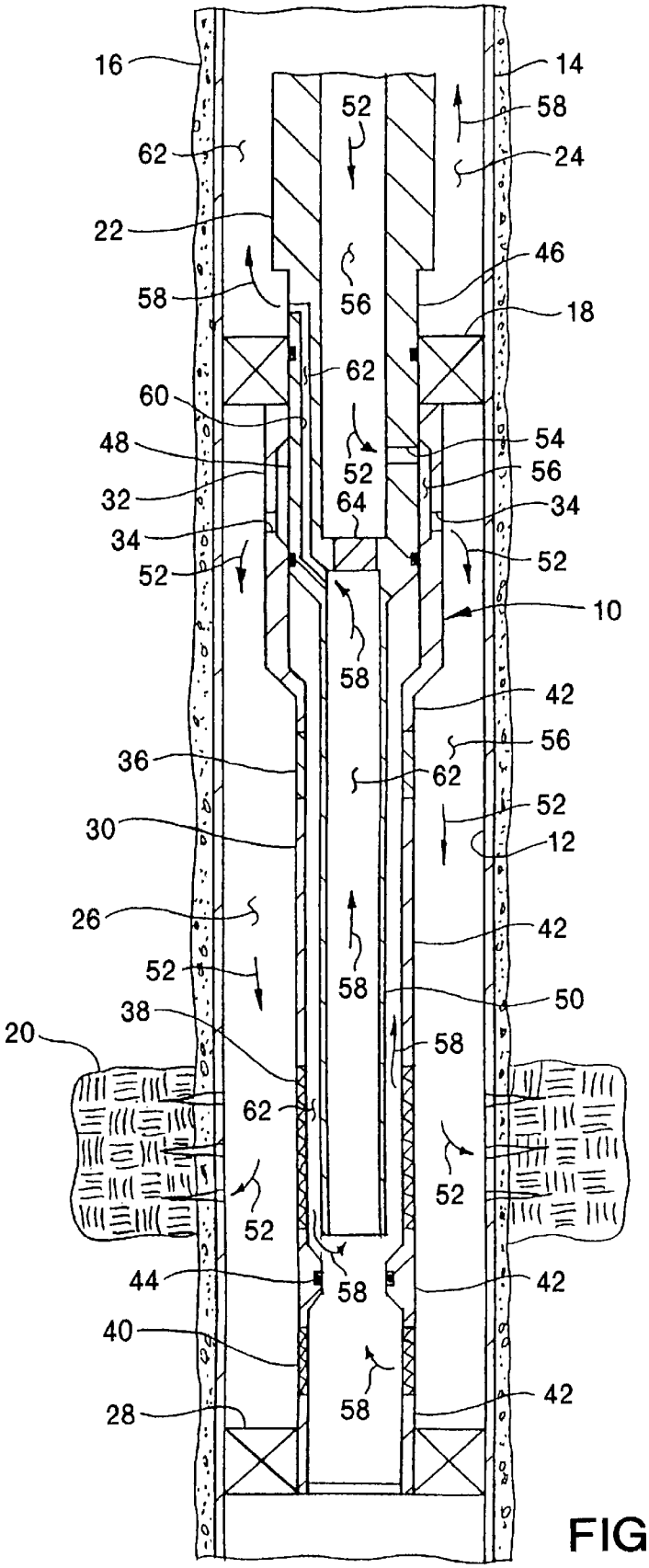
FIG. 1 is a schematic cross-sectional view of a well completion tool embodying principles of the present invention.

Representatively and schematically illustrated in FIG. 1 is a well tool 10 which embodies principles of the present invention. In the following description of the tool 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

As representatively illustrated in FIG. 1 the tool 10 is a well completion tool of the type which may be used in formation fracturing, gravel packing and other stimulation operations. The tool 1 is similar in many respects to the combined Multi-Position Tool® and Versa-Trieve® packer manufactured by, and available from, Halliburton Energy Services of Duncan, Okla. However, it is to be clearly understood that a tool constructed in accordance with the principles of the present invention may be otherwise configured, and may be utilized in other well completion operations, or in other types of wellsite operations.

The tool 10 is shown in FIG. 1 installed in a wellbore 12 lined with protective casing 14 and cement 16. A packer 18 of the tool 10 is set in the casing 14 above a formation 20 intersected by the wellbore 12. A service tool portion 22 of the tool 10 is sealingly and reciprocably received within the packer 18. The service tool 22 forms a lower portion of a tubular string extending to the earth's surface. An upper annulus 24 is thus formed above the packer 18, and radially between the casing 14 and the tubular string including the service tool 22.

A lower annulus 26 is formed axially between the packer 18 and a sump packer 28 set in the casing 14 below the formation 20. The lower annulus 26 is disposed radially between the casing 14 and a generally tubular assembly 30 sealingly attached to the packer 18 and sealingly engaged with the sump packer 28.

The assembly 30 includes an upper housing 32 having fluid passages 34 formed through a sidewall portion of the housing, a pressure relief device 36 embodying principles of the present invention, an upper screen 38 positioned opposite the formation 20, and a tell-tale screen 40 positioned below the upper screen. Various tubular sections 42 interconnect the above elements of the assembly 30 and may include other features, such as seals 44 or other elements, without departing from the principles of the present invention.

The service tool 22 includes an upper portion 46 sealingly received in the packer 18, a crossover housing 48 received in the upper housing 32, and a generally tubular washpipe 50 extending downward from the crossover housing and within the screen 38.

In a well completion operation, such as a formation fracturing or gravel packing operation, a slurry (indicated by arrows 52) including fluid and particulate matter, such as proppant or gravel, is pumped from the earth's surface through the tubular string including the service tool 22, into the crossover housing 48, outward through ports 54 (only one of which is visible in FIG. 1) formed radially through the crossover housing, outward through the fluid passages 34 of the upper housing 32, into the lower annulus 26, and may be forced into the formation 20. Thus, a fluid delivery flowpath 56 is formed by the interior of the tubular string including the service tool 22, the interior of the crossover housing 48, the ports 54, the fluid passages 34, and the lower annulus 26.

A fluid portion (indicated by arrows 58) of the slurry 52 may enter the assembly 30 via either or both of the screens 38, 40 and flow radially between the assembly 30 and the washpipe 50, into the interior of the washpipe, through generally longitudinally extending fluid conduits 60 (only one of which is visible in FIG. 1) formed through the crossover housing 48, and into the upper annulus 24 through the service tool upper portion 46. The fluid 58 may then flow through the upper annulus 24 to the earth's surface. Thus, a fluid return flowpath 62 is formed by the interior of the assembly 30, the washpipe 50, the fluid conduits 60 and the upper annulus 24.

It will be readily appreciated that if the slurry 52 is pumped from the earth's surface at a high flow rate through the fluid delivery flowpath 56 into the lower annulus 26, and the lower annulus quickly fills with particulate matter, such as proppant or gravel, fluid flow through the screens 38, 40 may be substantially restricted. Such flow restriction may result in an excessive pressure differential being created between the interior and exterior of the assembly 30 or, stated differently, between the fluid delivery and return flowpaths 56, 62. Left unchecked, this pressure differential may cause collapse or other damage to the tubular sections 42, screens 38, 40, and/or other portions of the tool 10.

In order to prevent such damage, the tool 10 is uniquely provided with the pressure relief device 36 in the assembly 30, and another pressure relief device 64 attached to the crossover housing 48. As utilized in the tool 10, each of the pressure relief devices 36, 64 provides a backup to the other in the event of a failure of one of them. It is to be clearly understood, however, that the tool 10 may be provided with only one of the pressure relief devices 36, 44, may be provided with other pressure relief devices, or may be provided with any combination of pressure relief devices, without departing from the principles of the present invention.

Figure 2:
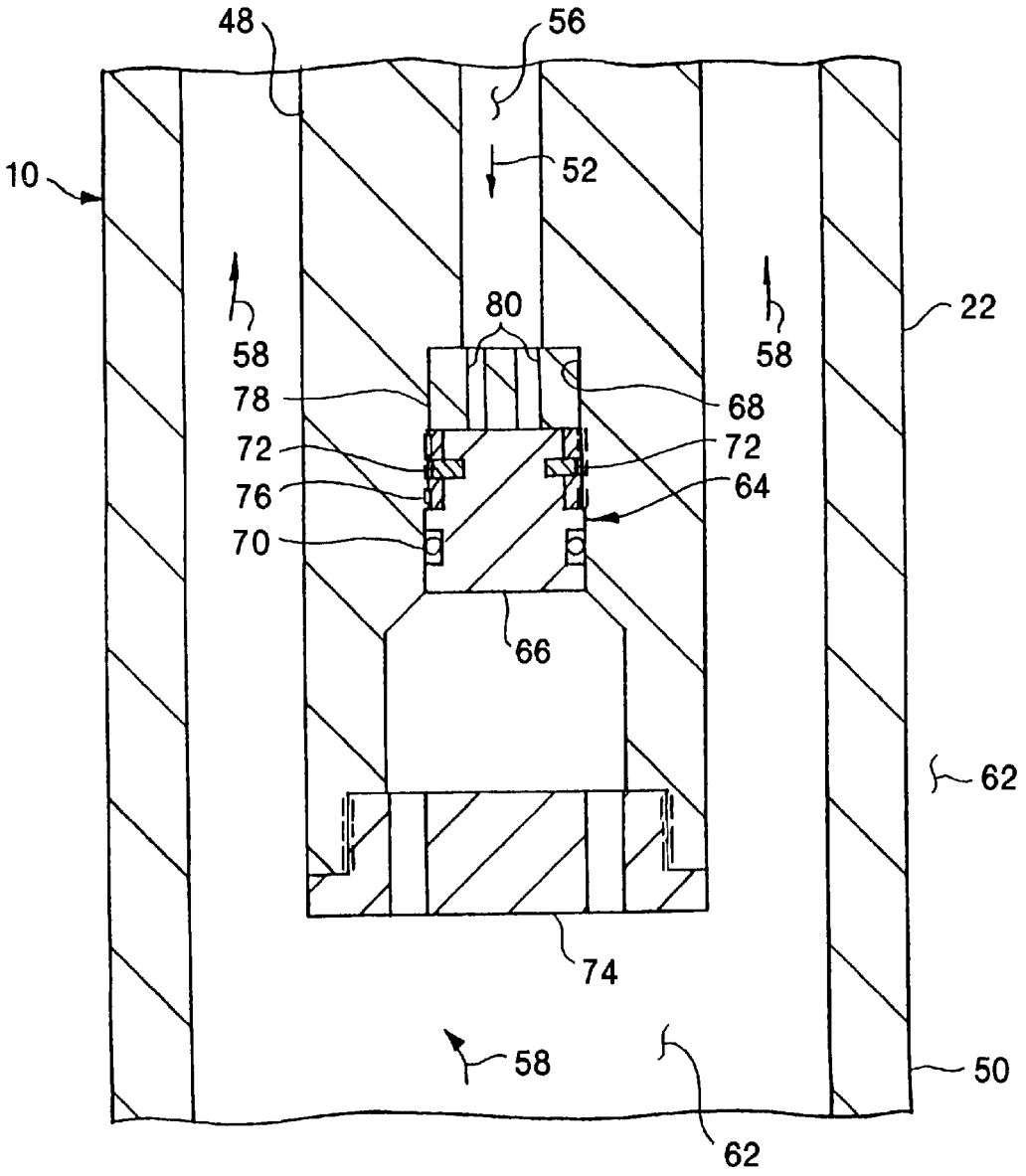
FIG. 2 is an enlarged scale schematic cross-sectional view of a first pressure relief device incorporated into the well completion tool of FIG. 1.

Referring additionally now to FIG. 2, a view of a portion of the service tool 22 is representatively and schematically illustrated in enlarged scale, showing the pressure relief device 64 installed in a lower portion of the crossover housing 48 extending downwardly within the washpipe 50. The pressure relief device 64 includes a generally cylindrical plug 66 received in an axial fluid passage 68. Note that one end of the passage 68 is in fluid communication with the fluid delivery flowpath 56 in the interior of the crossover housing 48, and the opposite end of the passage is in fluid communication with the fluid return flowpath 62 in the interior of the washpipe 50. Thus, the pressure relief device 64 is installed in a pressure-bearing wall of the crossover housing 48.

The plug 66 carries a circumferential seal 70 externally thereon for sealing engagement with the passage 68. Thus, the pressure relief device 64 prevents fluid communication between the fluid delivery and return flowpaths 56, 62 as shown in FIG. 2. However, the plug 66 is releasably secured in the passage 68, and when released for displacement relative to the passage, permits fluid flow therethrough as described more fully below.

The plug 66 is releasably secured in the passage 68 by one or more release members 72. As depicted in FIG. 2, the release members 72 are shear members or shear pins. The shear pins 72 are sized to shear upon application of a predetermined differential pressure to the plug 66, that is, a difference in pressure between the fluid delivery flowpath 56 and the fluid return flowpath 62. Preferably, the shear pins 72 are sized to shear at a differential pressure less than that which would cause damage to the tool. Of course, other types of release members, such as shear rings, shear screws, collets, et., may be used in place of the shear pins 72 without departing from the principles of the present invention.

When the predetermined differential pressure is applied to the pressure relief device 64, the shear pins 72 shear and the plug 66 displaces downwardly out of sealing engagement with the passage 68. Fluid flow is then permitted through the passage 68 between the fluid delivery, and return flowpaths 56, 62, thereby relieving the differential pressure therebetween. This relief of differential pressure occurs substantially immediately, without requiring any actions at the earth's surface and without any time lag between such actions and the relief of differential pressure.

A ported containment member 74 is threadedly attached to the crossover housing 48 below the plug 60. When the plug 66 is released for displacement relative to the passage 68, the containment member 74 retains the plug, preventing it from dropping into the washpipe 50. In this manner, the plug 66 may be retrieved from the well with the service tool 22, instead of being left in the assembly 30. Of course, the pressure relief device 64 is operative without the containment member 74, and its use is not necessary in the tool 10.

A securement member or ring 76 is threadedly installed in the passage 68. The ring 70 secures the shear pins 72 relative to the passage 68 and maintains engagement of the shear pins with the plug 66. The ring 76 also secures a filtering device 78 relative to the passage 68, so that the filtering device is positioned between the fluid delivery flowpath 56 and the plug 66.

As shown in FIG. 2, the filtering device 78 is generally disc-shaped and includes a series of slots 80 formed therethrough. The slots 80 are preferably of the type known to those of ordinary skill in the art as micro-slots. These types of slots are capable of substantially preventing flow of particulate matter therethrough, while permitting fluid to flow therethrough. In this manner, the assembly 30 is not filled with particulate matter, such as proppant or gravel, when the pressure relief device 64 opens. Of course, the slots 80 may be sized as desired to exclude corresponding sizes of particulate matter, and other types of filtering devices may be utilized, such as sintered metal, wire mesh, etc., without departing from the principles of the present invention.

Figure 3:
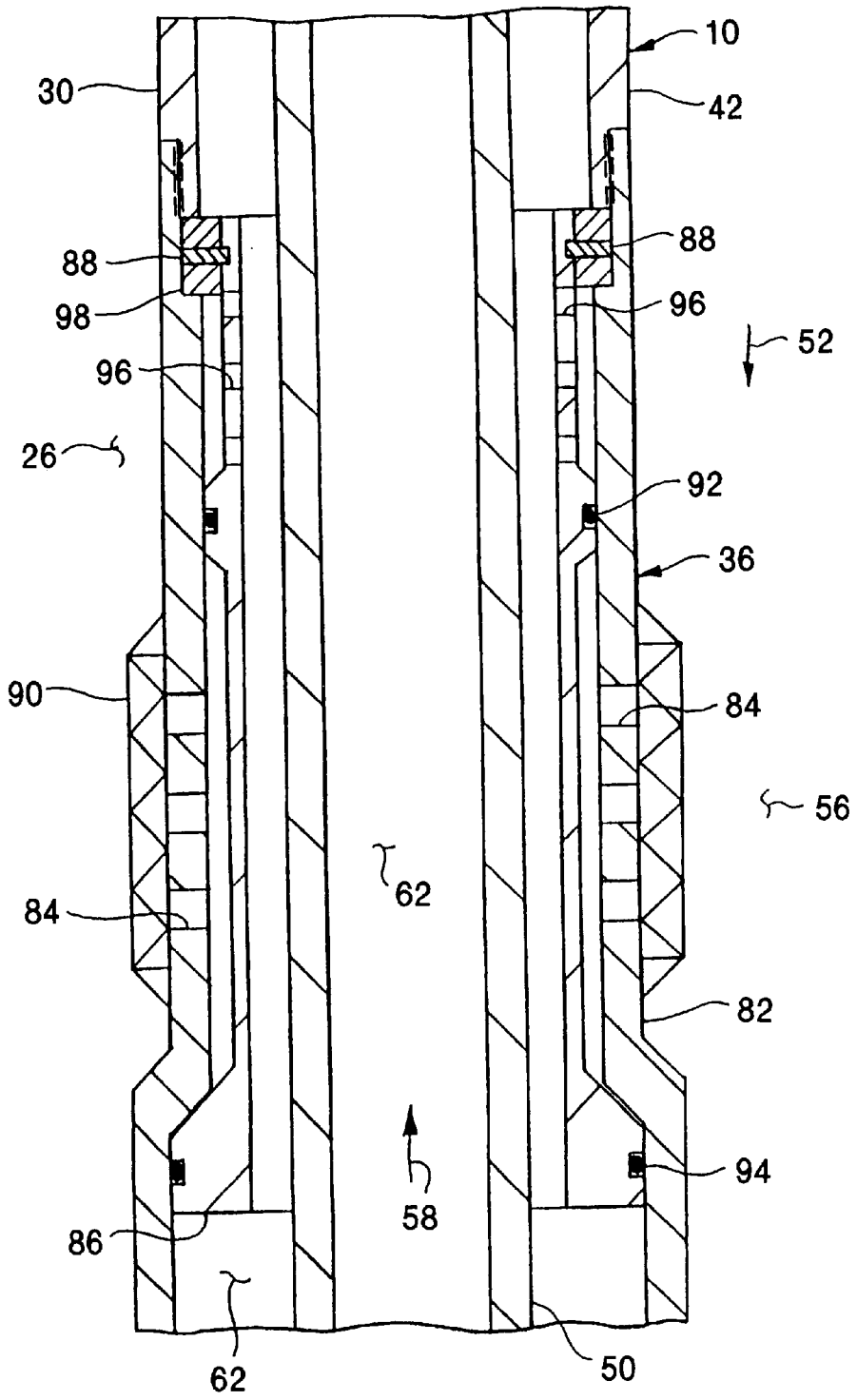
FIG. 3 is an enlarged scale schematic cross-sectional view of a second pressure relief device incorporated into the well completion tool of FIG. 1.

Referring additionally now to FIG. 3, an axial portion of the tool 10 is representatively and schematically illustrated in an enlarged scale, showing details of the pressure relief device 36. The pressure relief device 36 includes a generally tubular outer housing 82 having one or more fluid passages 84 formed through a sidewall portion thereof, a sleeve 80 axially reciprocably and sealingly received within the housing, one or more shear members 88 releasably securing the sleeve against displacement relative to the housing, and a generally tubular filtering device 90 radially outwardly overlying the fluid passages 84.

The sleeve 86 carries circumferential seals 92, 94 externally, thereon for sealing engagement with the interior of the housing 82. Note that the seal 92 is carried on a smaller diameter of the sleeve as compared to that of the seal 94. Thus, there is a differential piston area formed on the sleeve 86 between the seal diameters. It will be readily appreciated that this differential piston area is exposed on one side to fluid pressure in the fluid delivery flowpath 56 (acting through the filtering device 90 and passages 84) and on the other side to fluid pressure in the fluid return flowpath 62.

When the fluid pressure in the fluid delivery flowpath 56 exceeds the fluid pressure in the fluid return flowpath 62 by a predetermined amount, this differential fluid pressure causes the shear members 88 to shear, thereby releasing the sleeve 86 for displacement relative to the housing 82. As shown in FIG. 3, the sleeve 86 displaces downward, the seal 92 eventually traversing one or more of the passages 84 and permitting fluid flow therethrough. Of course, the sleeve 86 could be easily configured to displace upward, rotate, or otherwise displace relative to the housing 82, without departing from the principles of the present invention.

When the sleeve 86 displaces relative to the housing 82 and permits fluid flow through the passages 84, the pressure differential between the fluid delivery flowpath 56 and the fluid return flowpath 62 is relieved substantially immediately. It is recognized that, with relief of the pressure differential, the sleeve 86 may not fully uncover the passages 84, and so one or more flow, ports 96 are provided in an upper portion of the sleeve 86. However, these ports are not necessary in a pressure relief device constructed in accordance with the principles of the present invention.

The filtering device is representatively illustrated in FIG. 3 as a conventional wire-wrapped screen welded to the exterior of the housing 82. Of course, other types of filtering devices, such as sintered metal, wire mesh, etc., may be used in place of the screen 90. Alternatively, the filtering device 90 may take the form of the passages 84 being provided as micro-slots, the filtering device may be installed on the interior of the housing 82, may be disposed within the passages 84, etc. If the filtering device 90 is installed on the interior of the housing 82, the sleeve 86 could easily be positioned on the exterior of the housing if desired.

The shear members 88 are shown inserted through a securement member or ring 98, which is retained axially between the housing 82 and one of the tubular sections 42 of the assembly 30. As with the shear pins 72 described above, the shear members 88 may be any form of release members, and are preferably sized to release the sleeve 86 for displacement relative to the housing 82 at a predetermined differential pressure less than that at which damage is caused to the tool 10 or any portion thereof. Additionally, since the wellsite operation may be continued even after one of the pressure relief devices 36, 64 has opened, the shear members 88 may be sized to release the sleeve 86 at a differential pressure the same as, greater than, or less than, that at which the shear members 72 release the plug 60 for displacement relative to the crossover housing 48.

Note that the sidewall portion of the housing 82 through which the passages 84 are formed is a pressure-bearing wall of the assembly 30, exposed on its interior to fluid pressure in the fluid return flowpath 62, and on its exterior to fluid pressure in the fluid delivery flowpath 56. Therefore, when the sleeve 86 is displaced relative to the housing 82 and fluid flow is permitted through the passages 84, the difference in fluid pressure between the fluid delivers and return flowpaths 56, 62 is substantially immediately relieved.

Thus has been described the tool 10 including the pressure relief devices 36, 64 incorporated therein, which operate to protect the tool from harmful differential pressures between fluid delivery and return flowpaths 56, 62 thereof. Of course, many modifications, additions, substitutions, deletions and other changes may be made to the exemplary embodiment of the invention described above, which changes would be obvious to one of ordinary skill in the art. For example, the filtering devices 78, 90 could be otherwise configured, or eliminated if it is not desired to exclude particulate matter from the fluid return flowpath 62, without departing from the principles of the present invention. Accordingly, the foregoing detailed description is to be clearly understood as being given by way of illustration and example only, the spirit and scope of the present invention being limited solely by the appended claims.

What is claimed is:

1. A well completion tool operatively positionable within a subterranean well, the tool comprising:

a fluid delivery flowpath configured for delivering fluid into the well;

a fluid return flowpath configured for returning fluid from the well;

a first pressure relief device in fluid communication with the fluid delivery and fluid return flowpaths, the first pressure relief device being operative to provide fluid communication between the fluid delivery and fluid return flowpaths upon application of a first predetermined fluid pressure differential between the fluid delivery flowpath and the fluid return flowpath, the first pressure relief device including a plug releasably secured in a passage formed through a pressure-bearing wall of a housing of the well completion tool, the wall separating the fluid delivery flowpath from the fluid return flowpath, the plug being releasably secured in the passage by at least one shear member, the shear member shearing upon application of the first fluid pressure differential; and a filtering device disposed between the fluid delivery flowpath and the plug.

2. The well completion tool according to claim 1, wherein the filtering device comprises a member having a series of slots formed therethrough.

3. A well completion tool operatively positionable within a subterranean well, the tool comprising:

a fluid delivery flowpath configured for delivering fluid into the well;

a fluid return flowpath configured for returning fluid from the well;

a first pressure relief device in fluid communication with the fluid delivery and fluid return flowpaths, the first pressure relief device being operative to provide fluid communication between the fluid delivery and fluid return flowpaths upon application of a first predetermined fluid pressure differential between the fluid delivery flowpath and the fluid return flowpath, the first pressure relief device including a plug releasably secured in a passage formed through a pressure-bearing wall of a housing of the well completion tool, the wall separating the fluid delivery flowpath from the fluid return flowpath, the plug being generally cylindrical-shaped and carrying a circumferential seal externally thereon, the seal sealingly engaging the passage; and a generally disc-shaped filtering device disposed between the fluid delivery flowpath and the plug, the filtering device providing fluid communication between the fluid delivery flowpath and the plug, but substantially preventing flow of particulate matter from the fluid delivery flowpath to the fluid return flowpath.

4. A well completion tool operatively positionable within a subterranean well, the tool comprising:

a fluid delivery flowpath configured for delivering fluid into the well;

a fluid return flowpath configured for returning fluid from the well;

a first pressure relief device in fluid communication with the fluid delivery and fluid return flowpaths, the first pressure relief device being operative to provide fluid communication between the fluid delivery and fluid return flowpaths upon application of a first predetermined fluid pressure differential between the fluid delivery flowpath and the fluid return flowpath, the first pressure relief device including a plug releasably secured in a passage formed through a pressure-bearing wall of a housing of the well completion tool, the wall separating the fluid delivery flowpath from the fluid return flowpath; and a second pressure relief device, the second pressure relief device providing fluid communication between interior and exterior portions of the well completion tool through a sidewall portion thereof upon application of a second fluid pressure differential between the interior and exterior portions of the well completion tool.

5. The well completion tool according to claim 4, wherein the second pressure relief device includes a sleeve releasably secured relative to the sidewall portion, the sleeve displacing relative to the sidewall portion and permitting fluid communication between the interior and exterior portions upon application of the second fluid pressure differential.

6. The well completion tool according to claim 5, wherein the second pressure relief device further includes a filtering device disposed relative to the sidewall portion, the filtering device substantially preventing flow of particulate matter through the sidewall portion when the sleeve displaces relative to the sidewall portion.

7. A pressure relief device for use in a well tool having first and second internal flowpaths communicated with one another via a first route, the device comprising:

a fluid passage having opposite ends and a seal surface formed between the opposite ends, one of the opposite ends being fluid communicable with the first flowpath, and the other opposite end being fluid communicable with the second flowpath;

a plug disposed at least partially within the passage, the plug sealingly engaging the passage and preventing fluid flow therethrough; and at least one release member releasably securing the plug relative to the passage, the release member releasing the plug for displacement relative to the passage, when fluid pressure in the passage at one of the opposite ends exceeds fluid pressure at the other of the opposite ends by a predetermined amount, in a manner further communicating the first and second internal flow paths, in addition to their communication via the first route, via a second route which extends through the passage.

8. The pressure relief device according to claim 7, wherein the plug is sealingly disengaged from the passage when the release member releases the plug, thereby permitting fluid flow through the passage.

9. The pressure relief device according to claim 7, further comprising a filtering device disposed within the passage.

10. The pressure relief device according to claim 9, wherein the filtering device is positioned between the one of the passage opposite ends and the plug.

11. The pressure relief device according to claim 10, wherein the filtering device includes a series of slots formed therethrough, the slots permitting fluid flow therethrough, but substantially preventing particulate flow therethrough.

12. The pressure relief device according to claim 10, further comprising a securement member, the securement member securing the filtering device relative to the passage.

13. The pressure relief device according to claim 12, wherein the securement member further secures the release member relative to the passage.

14. The pressure relief device according to claim 7, further comprising a containment member secured relative to the passage other opposite end, the containment member limiting displacement of the plug relative to the passage other opposite end when the release member releases the plug for displacement relative to the passage.

15. A method of protecting a well completion tool, the method comprising the steps of:

sealingly engaging a plug within a fluid passage of the well completion tool, the passage extending between a fluid delivery flowpath disposed within the tool and a fluid return flowpath disposed within the tool and communicated with the fluid return flowpath via a first route external to the passage;

releasably securing the plug within the passage;

applying a predetermined fluid pressure differential between the fluid delivery and return flowpaths; and sealingly disengaging the plug from the passage, thereby permitting fluid flow between the fluid delivery and return flowpaths, in addition to their communication via the first route, via a further second route extending through the passage.

16. The method according to claim 15, wherein the releasably securing step is performed by installing at least one shear member in the well completion tool.

17. The method according to claim 16, wherein the sealingly disengaging step is performed by shearing the shear member to thereby permit displacement of the plug relative to the passage.

18. The method according to claim 15, further comprising the step of filtering fluid flowing through the passage after the step of sealingly disengaging the plug.

19. The method according to claim 18, wherein the filtering step is performed by positioning a filtering device relative to the passage.

20. The method according to claim 19, wherein the filter positioning step further comprises positioning the filtering device between the fluid delivery flowpath and the plug.

21. A method of protecting a well tool, the method comprising the steps of:

positioning a pressure relief device in fluid communication with fluid delivery and fluid return flowpaths of the well tool;

actuating the pressure relief device to thereby provide fluid communication between the fluid delivery and fluid return flowpaths upon application of a predetermined fluid pressure differential between the fluid delivery and fluid return flowpaths;

providing the pressure relief device including a plug releasably secured in a passage formed through a pressure-bearing wall of a housing of the well tool, the wall separating the fluid delivery flowpath from the fluid return flowpath; and filtering fluid flowing through the passage after the actuating step, the filtering step being performed by a filtering device installed between the plug and the fluid delivery flowpath.

22. The method according to claim 21, further comprising the step of releasably securing the plug in the passage with at least one shear member, and wherein the actuating step further comprises shearing the shear member.

23. The method according to claim 21, wherein the fluid delivery flowpath extends to an exterior portion of the well tool and the fluid return flowpath extends to an interior portion of the well tool, the interior and exterior portions being separated by a sidewall portion of the well tool, and wherein in the actuating step the pressure relief device provides fluid communication between the inthrough and exterior portions through the sidewall portion.

* * * * *